US011828446B2

(12) United States Patent
Chen et al.

(10) Patent No.: US 11,828,446 B2
(45) Date of Patent: Nov. 28, 2023

(54) WINDING MECHANISM AND LAMP

(71) Applicant: Radiant Opto-Electronics Corporation, Kaohsiung (TW)

(72) Inventors: Chung-Kuang Chen, Kaohsiung (TW); Guo-Hao Huang, Kaohsiung (TW); Chih-Hung Ju, Kaohsiung (TW); Cheng-Ang Chang, Kaohsiung (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 0 days.

(21) Appl. No.: 18/104,778

(22) Filed: Feb. 1, 2023

(65) Prior Publication Data

US 2023/0204197 A1 Jun. 29, 2023

Related U.S. Application Data

(63) Continuation of application No. PCT/CN2022/081678, filed on Mar. 18, 2022.

(30) Foreign Application Priority Data

Dec. 29, 2021 (CN) ..... 202111634837.8

(51) Int. Cl.
*F21V 21/38* (2006.01)
*F21V 21/15* (2006.01)
(Continued)

(52) U.S. Cl.
CPC ..... *F21V 21/38* (2013.01); *B65H 75/486* (2013.01); *F21V 21/15* (2013.01); *F21V 23/002* (2013.01); *B65H 2701/34* (2013.01)

(58) Field of Classification Search
CPC ..... F21V 27/00; F21V 21/38; F21V 21/008; B65H 75/2413
See application file for complete search history.

(56) References Cited

U.S. PATENT DOCUMENTS 9,815,670 B2 * 11/2017 Bauder ..... B66D 3/18
11,435,072 B1 * 9/2022 Shott ..... F21V 21/16
(Continued)

FOREIGN PATENT DOCUMENTS

CN 2593044 Y 12/2003
CN 105222026 A 1/2016
(Continued)

*Primary Examiner* — Alexander K Garlen
(74) *Attorney, Agent, or Firm* — Winston Hsu

(57) ABSTRACT

A winding mechanism includes a housing, an inner cylinder and a wire. The housing is formed with an accommodating space therein. An inner surface of the housing is formed with an internal thread structure. The inner cylinder is disposed in the accommodating space and defines a central axis. An outer surface of the inner cylinder is formed with an external thread structure. The external thread structure is cooperated with the internal thread structure. The inner cylinder is capable of displacing along the central axis by rotating relative to the housing. The external thread structure includes at least two contact portions and at least two non-contact portions, and gaps are formed between the non-contact portions of the external thread structure and the internal thread structure. An end of the wire is connected to the inner cylinder and is wound along the external thread structure of the inner cylinder.

20 Claims, 12 Drawing Sheets

(51) Int. Cl.
*B65H 75/48* (2006.01)
*F21V 23/00* (2015.01)

(56) References Cited

U.S. PATENT DOCUMENTS

| | | | | |
|---|---|---|---|---|
| 2003/0095412 | A1 | 5/2003 | Weinhuber | |
| 2006/0285939 | A1* | 12/2006 | Mcduff | B65H 75/4421 411/135 |
| 2007/0127234 | A1* | 6/2007 | Jervey, III | F21V 21/02 362/147 |

FOREIGN PATENT DOCUMENTS

| | | | | |
|---|---|---|---|---|
| CN | 210366339 | U | 4/2020 | |
| CN | 210662535 | U | 6/2020 | |
| CN | 212805293 | U | 3/2021 | |
| CN | 212849734 | U | 3/2021 | |
| EP | 1069375 | A2 * | 1/2001 | B65H 75/4402 |
| EP | 1887280 | A1 | 2/2008 | |

* cited by examiner

WINDING MECHANISM AND LAMP

CROSS REFERENCE TO RELATED APPLICATIONS

This application is a continuation application of PCT Application No. PCT/CN2022/081678, filed on Mar. 18, 2022, which claims priority of China Application No. 202111634837.8, filed on Dec. 29, 2021. The entire disclosures of all the above applications are incorporated herein by reference.

BACKGROUND OF THE INVENTION

1. Field of the Invention

The present disclosure relates to a winding mechanism and a lamp, and more particularly, to a winding mechanism capable of reducing a volume thereof and enhancing the smoothness of winding and unwinding a wire and a lamp having the winding mechanism.

2. Description of the Prior Art

A winding mechanism is a mechanism configured for winding or unwinding a wire, which can adjust an exposed length of the wire, and can be applied to daily life items to satisfy requirements of modern people for the functionality of items or personalized life.

Take a pendant lamp as an example. The pendant lamp includes a suspension wire and a lamp body, one end of the suspension wire is connected to a ceiling, and another end of the suspension wire is connected to the lamp body. Based on a space where the pendant lamp installed and an arrangement of surrounding furnishings, changing the hanging length of the suspension wire can create different spacious senses and designs. When the winding mechanism is applied to the pendant lamp, it is beneficial to adjust the hanging length of the suspension wire according to the needs of users.

However, the lamp whose hanging length is adjustable usually has the suspension wire not wound along a fixed track, and thus need a larger space for receiving the suspension wire. Alternatively, the lamp has the suspension wire wound along a fixed track, however, when winding and unwinding the suspension wire, the suspension wire is easy to get stuck due to the mechanism configuration. Accordingly, the smoothness of winding and unwinding the suspension wire is poor.

SUMMARY OF THE INVENTION

According to one embodiment of the present disclosure, a winding mechanism includes a housing, an inner cylinder and a wire. The housing is formed with an accommodating space therein. An inner surface of the housing is formed with an internal thread structure. The inner cylinder is disposed in the accommodating space. The inner cylinder defines a central axis. An outer surface of the inner cylinder is formed with an external thread structure. The external thread structure is cooperated with the internal thread structure. The inner cylinder is capable of displacing along the central axis by rotating relative to the housing. The external thread structure includes at least two contact portions and at least two non-contact portions, and gaps are formed between the non-contact portions of the external thread structure and the internal thread structure. An end of the wire is connected to the inner cylinder and is wound along the external thread structure of the inner cylinder. As the inner cylinder is displaced along the central axis by rotating relative to the housing, a portion of the wire is capable of being wound around or separated from the external thread structure of the inner cylinder.

According to another embodiment of the present disclosure, a lamp includes the aforementioned winding mechanism and a lamp body. The winding mechanism is suspended on an external support. The lamp body is connected to another end of the wire.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part thereof, and in which is shown by way of illustration specific embodiments in which the disclosure may be practiced. In this regard, directional terminology, such as up, down, left, right, front, back, bottom, top, etc., is used with reference to the orientation of the Figure(s) being described. As such, the directional terminology is used for purposes of illustration and is in no way limiting. In addition, identical numeral references or similar numeral references are used for identical elements or similar elements in the following embodiments.

Figure 1:
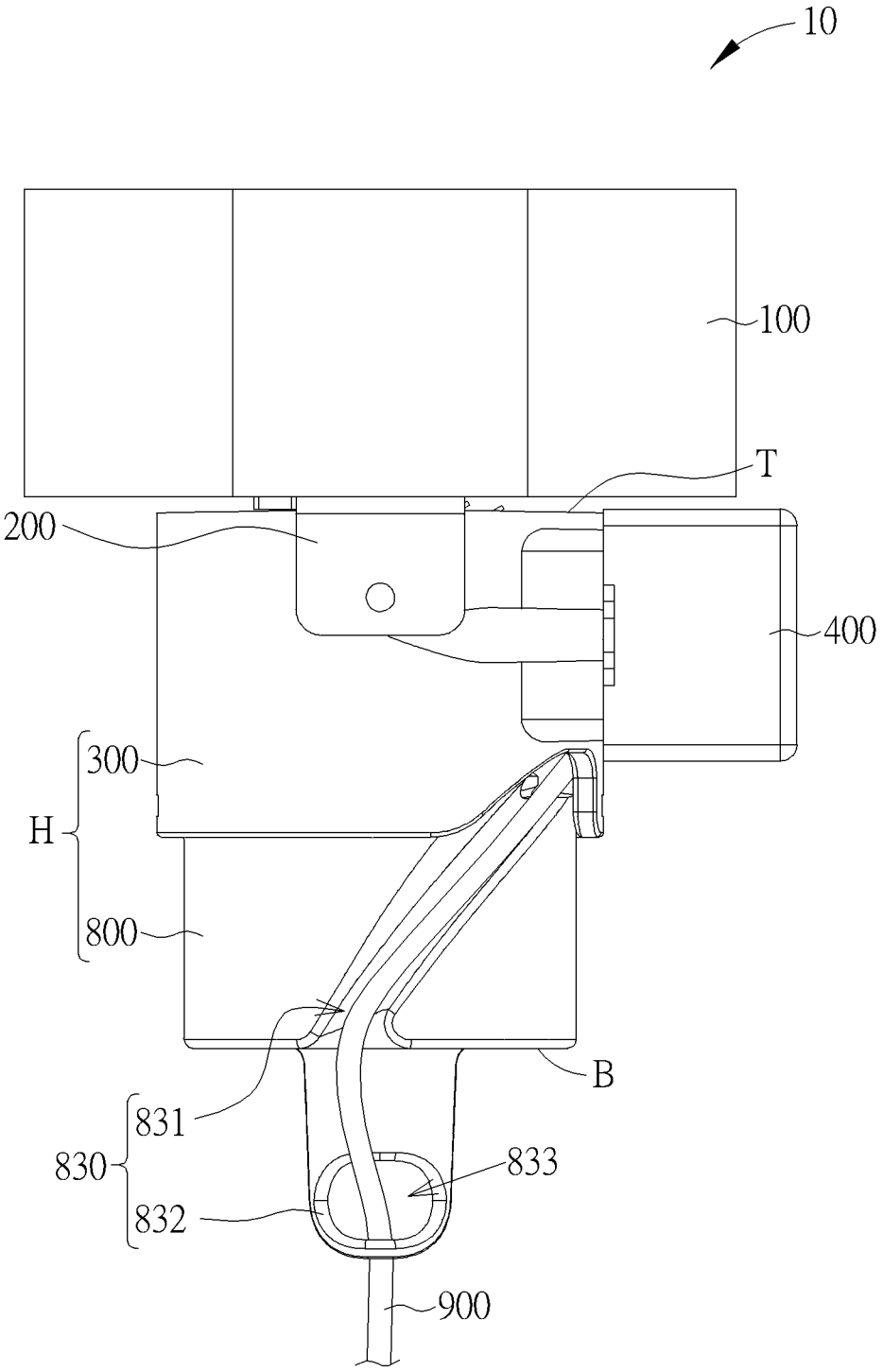
FIG. 1 is a combination schematic view showing a winding mechanism according to one embodiment of the present disclosure.
Figure 2:
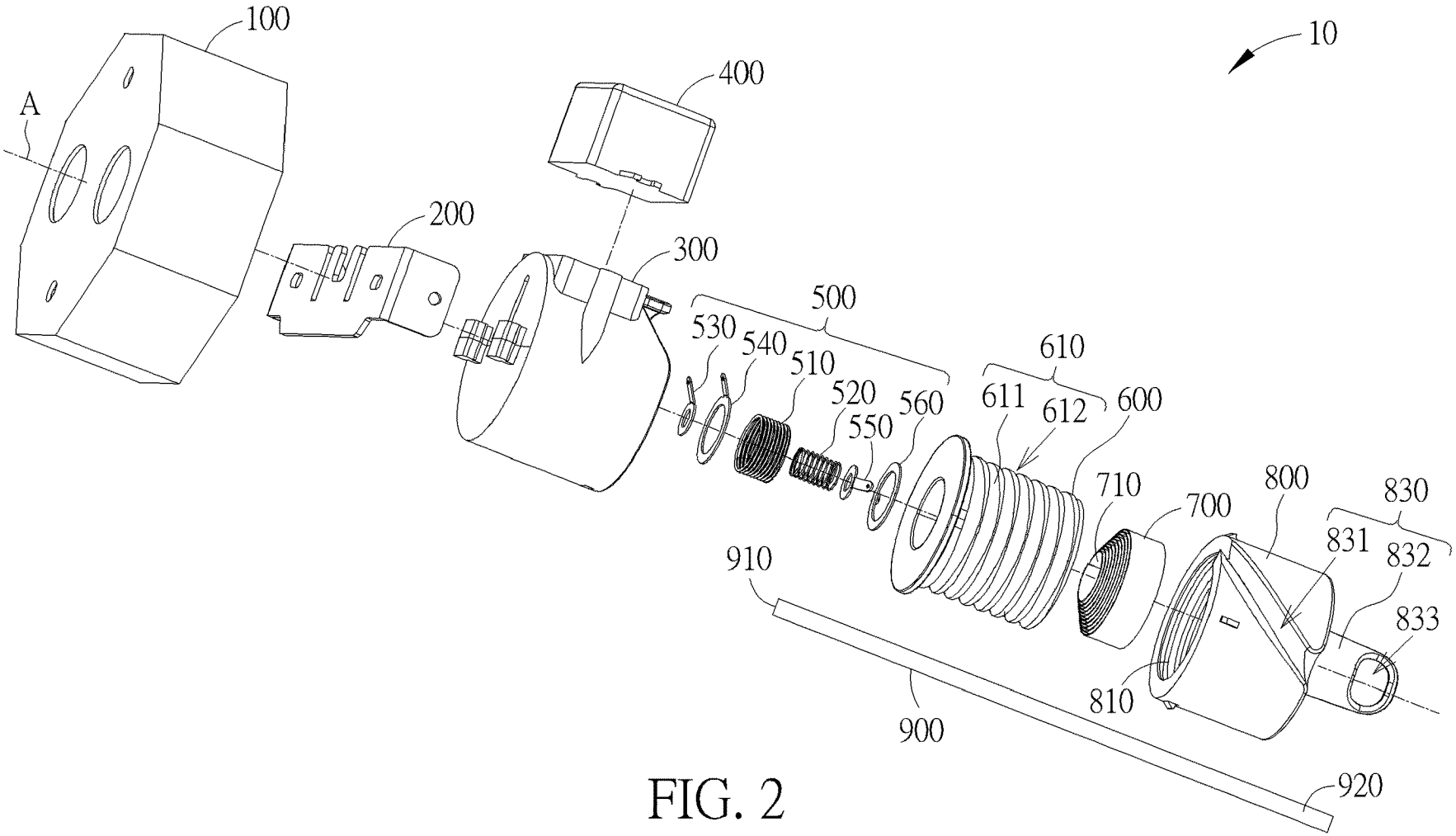
FIG. 2 is an exploded schematic view showing the winding mechanism of FIG. 1.
Figure 3:
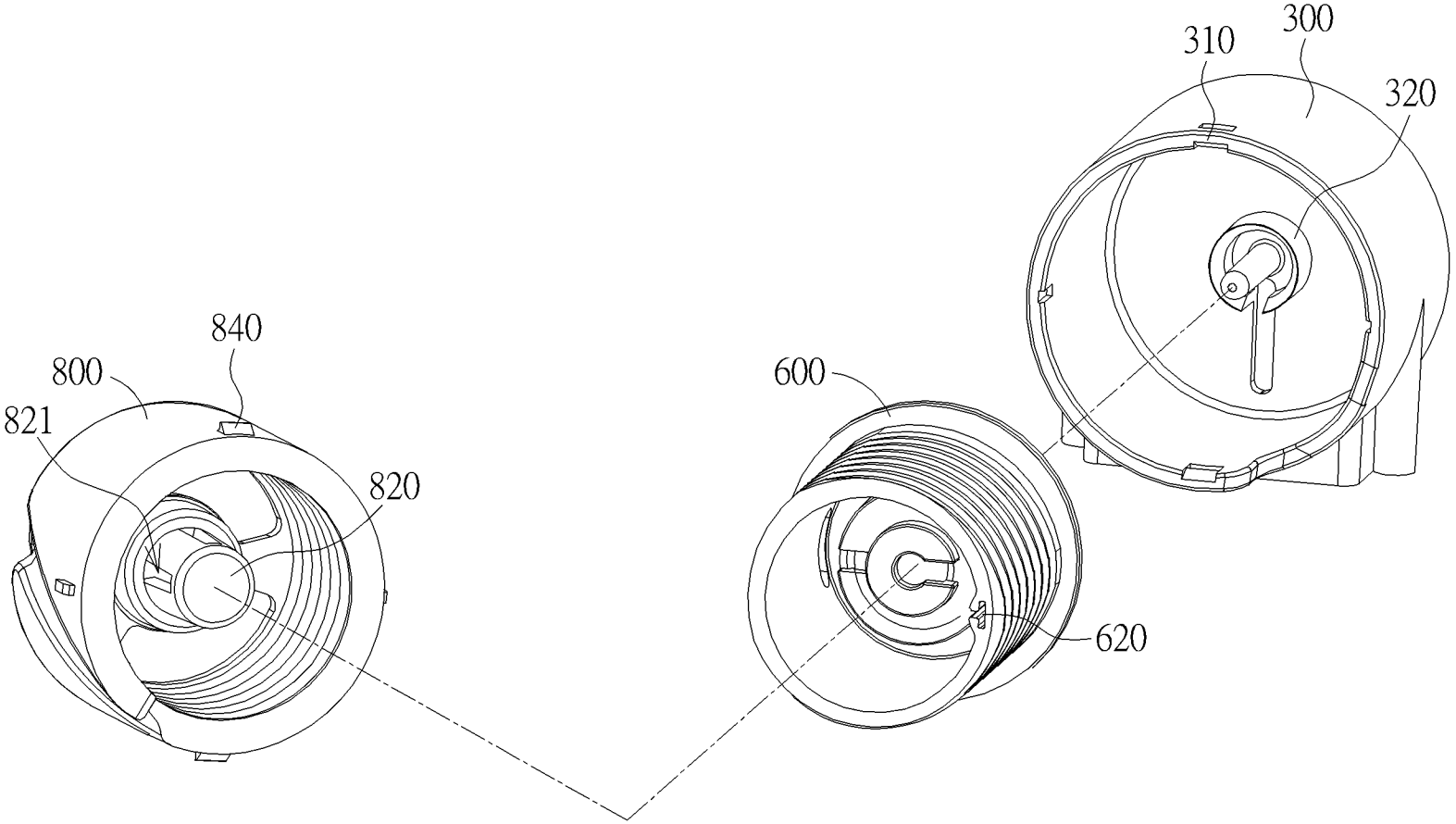
FIG. 3 is another exploded schematic view showing a first body, an inner cylinder and a second body of FIG. 2.
Figure 4:
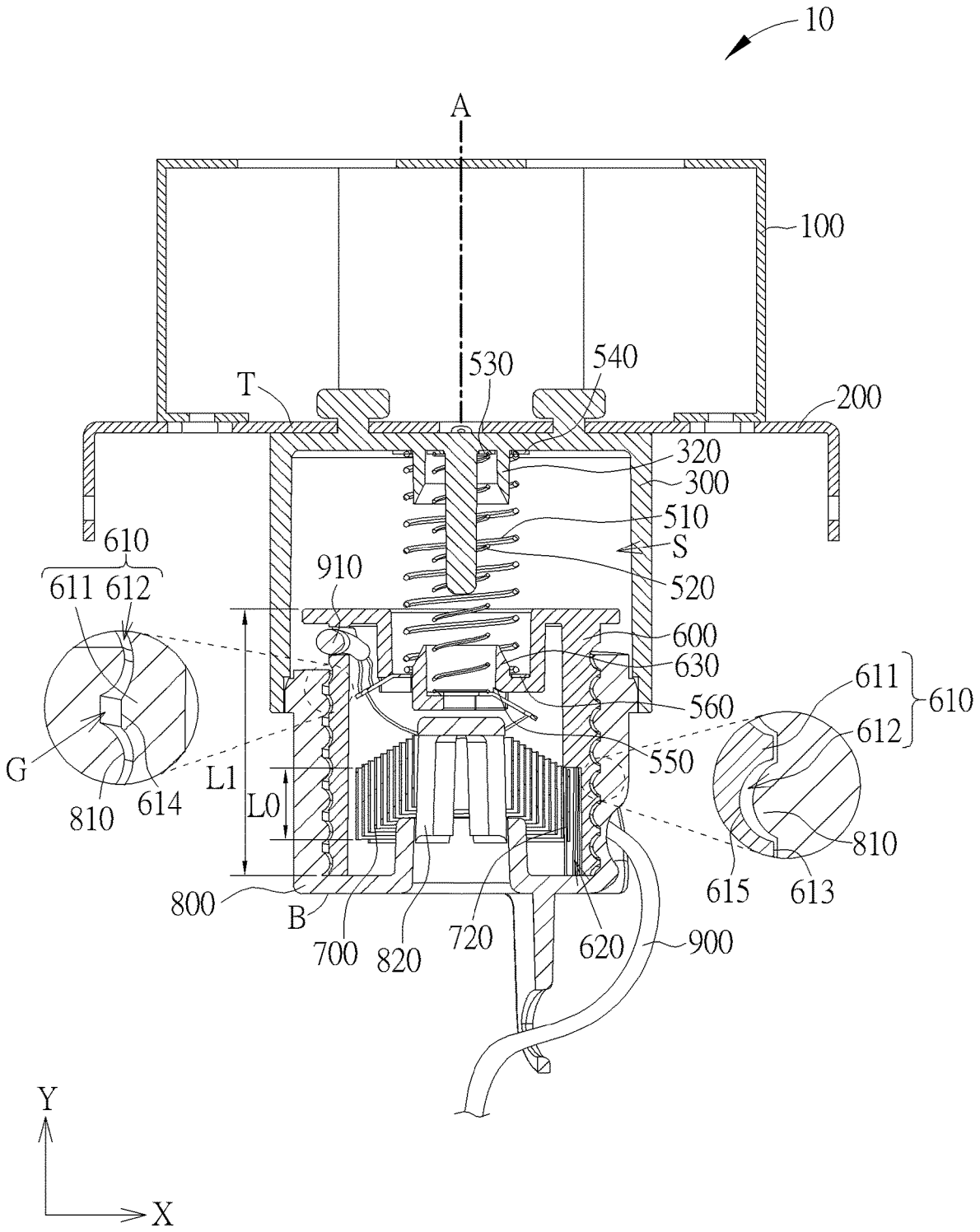
FIG. 4 is a cross-sectional view showing the winding mechanism of FIG. 1.
Figure 5:
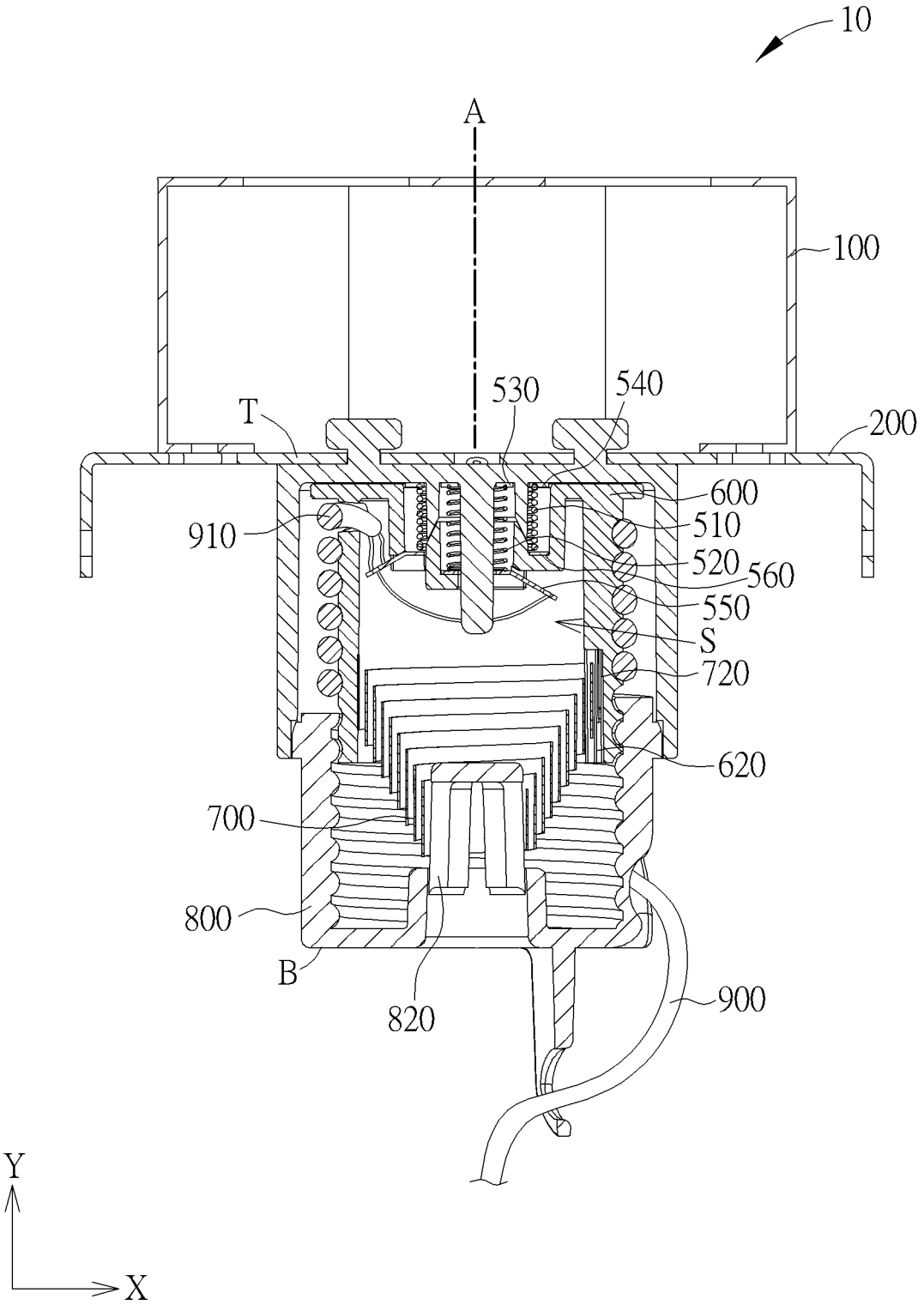
FIG. 5 is another cross-sectional view showing the winding mechanism of FIG. 1.

Please refer to FIG. 1 to FIG. 5. FIG. 1 is a combination schematic view showing a winding mechanism 10 according to one embodiment of the present disclosure. FIG. 2 is an exploded schematic view showing the winding mechanism 10 of FIG. 1. FIG. 3 is another exploded schematic view showing a first body 300, an inner cylinder 600 and a second body 800 of FIG. 2. FIG. 4 is a cross-sectional view showing the winding mechanism 10 of FIG. 1. FIG. 5 is another cross-sectional view showing the winding mechanism 10 of FIG. 1. The winding mechanism 10 includes a housing H, the inner cylinder 600 and a wire 900. The housing H can include the first body 300 and the second body 800. The first body 300 and the second body 800 are engaged with each other through an engaging groove 310 and a protrusion 840 (shown in FIG. 3). The housing H is formed with an accommodating space S therein. An inner surface of the housing H is formed with an internal thread structure 810. Herein, the internal thread structure 810 is exemplarily formed on an inner surface of the second body 800. The first body 300 is configured to be fixed on an external support such as a ceiling. A relative position between the first body 300 and the external support is fixed. The housing H can further include a guiding structure 830. Herein, the guiding structure 830 is exemplarily formed on the second body 800. The wire 900 enters the accommodating space S or leaves the accommodating space S through the guiding structure 830. The guiding structure 830 can include a concave groove 831 and a lug 832. The concave groove 831 is formed on an outer surface of the housing H. The lug 832 extends from a bottom end B of the housing H. The lug 832 is formed with a through hole 833. The wire 900 passes through the through hole 833.

Figure 6:
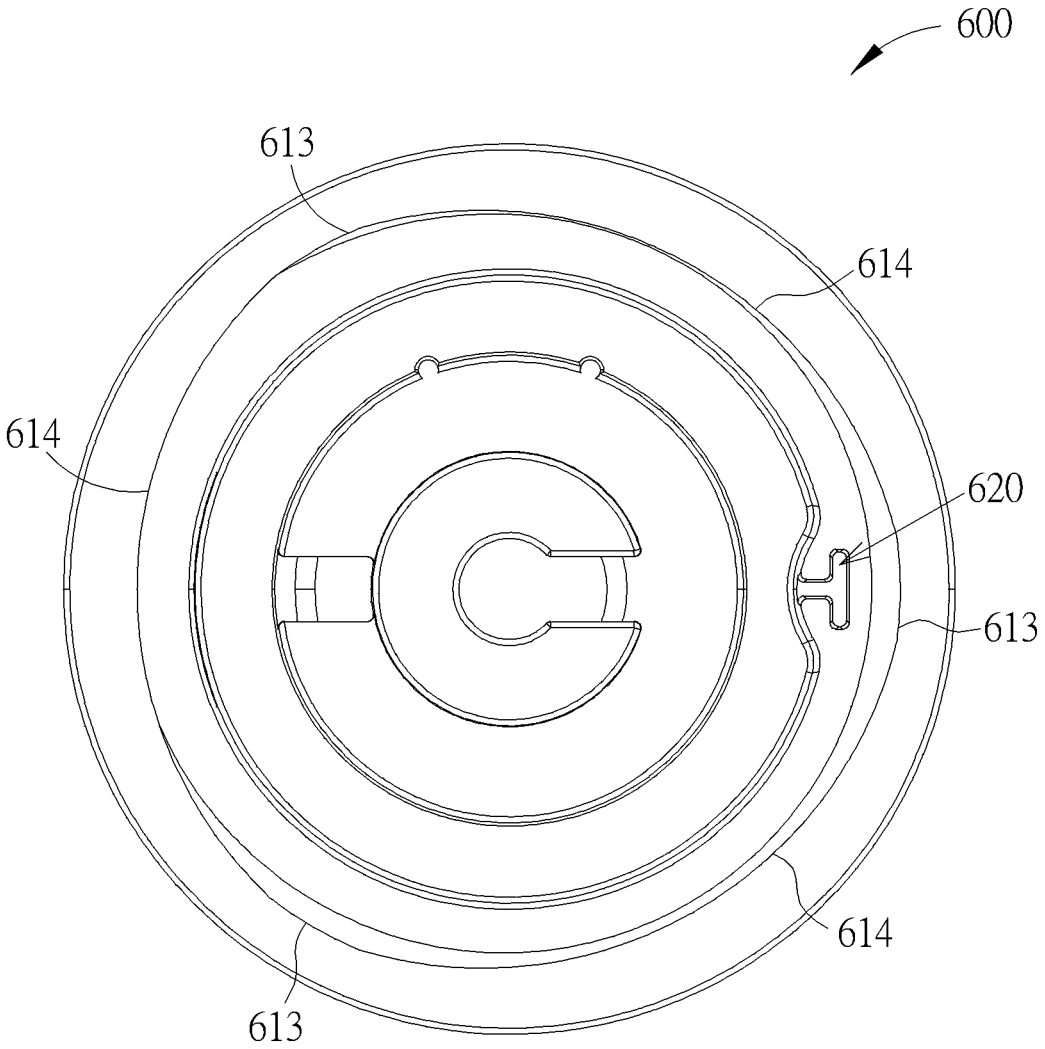
FIG. 6 is a bottom view showing the inner cylinder of the winding mechanism of FIG. 1.
Figure 7:
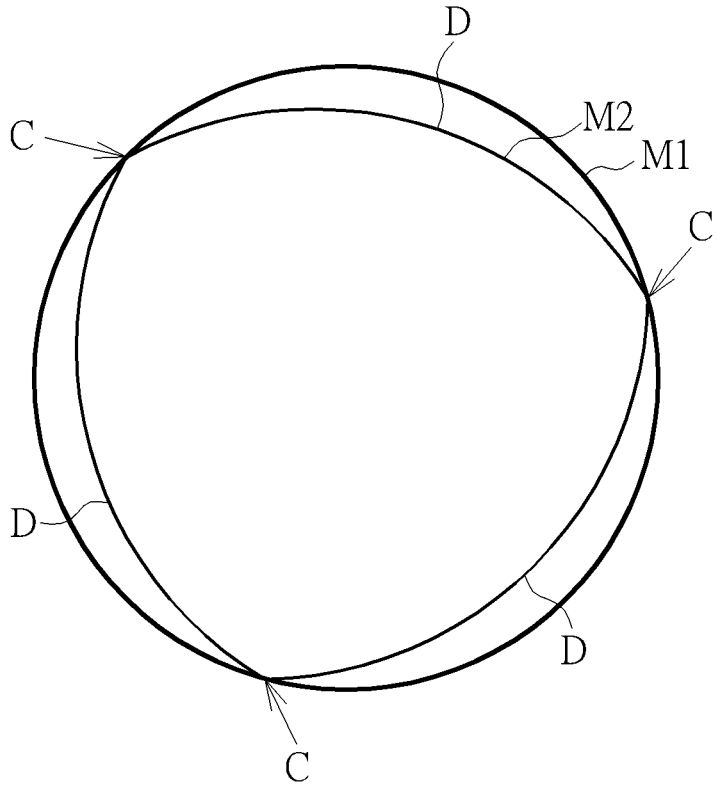
FIG. 7 is a schematic view showing projections of an external thread structure of the inner cylinder and an internal thread structure of a housing on a plane perpendicular to a central axis according to the winding mechanism in FIG. 1.

The inner cylinder 600 is disposed in the accommodating space S. The inner cylinder 600 defines a central axis A. An outer surface of the inner cylinder 600 is formed with an external thread structure 610. The external thread structure 610 is cooperated with the internal thread structure 810, so that the inner cylinder 600 is capable of displacing along the central axis A by rotating relative to the housing H. As shown in FIG. 2, the external thread structure 610 includes a plurality of threads 611 and a plurality of thread grooves 612. The threads 611 and the thread grooves 612 are arranged alternately. That is, a thread groove 612 is disposed between two of the plurality of threads 611 adjacent to each other. As shown in FIG. 4, the thread groove 612 can have an arc-shaped bottom surface 615. Thereby, the smoothness of winding and unwinding the wire 900 can be improved. Please refer to FIG. 6, which is a bottom view showing the inner cylinder 600 of the winding mechanism 10 of FIG. 1. The external thread structure 610 includes at least two contact portions 613 and at least two non-contact portions 614. In the embodiment, each of the threads 611 of the external thread structure 610 includes three contact portions 613 and three non-contact portions 614. The contact portions 613 and the non-contact portions 614 of each of the threads 611 are arranged alternately, and the three contact portions 613 of each of the threads 611 are spaced apart by equal angular intervals relative to the central axis A. The threads 611 are aligned with each other along the central axis A. Specifically, the contact portions 613 of a thread 611 is aligned with the contact portions 613 of an adjacent thread 611 along the central axis A, so that projections of the plurality of threads 611 on a plane perpendicular to the central axis A are overlapped. Please refer to FIG. 7, which is a schematic view showing projections of the external thread structure 610 of the inner cylinder 600 and the internal thread structure 810 of the housing H on the plane perpendicular to the central axis A according to the winding mechanism 10 in FIG. 1. The projection of the internal thread structure 810 on the plane perpendicular to the central axis A is M1 (hereinafter, projection M1), and the projection M1 is a circle. The projection of the external thread structure 610 on the plane perpendicular to the central axis A is M2 (hereinafter, projection M2), and the projection M2 is a regular triangle. The projection of the contact portion 613 on the plane perpendicular to the central axis A is C (hereinafter, projection C), and the projection C abuts or is near the projection M1. The projection of the non-contact portion 614 on the plane perpendicular to the central axis A is D (hereinafter, projection D), and the projection D is located inside the projection M1. Thereby, a gap G (see FIG. 4) is formed between the non-contact portion 614 of the external thread structure 610 and the internal thread structure 810, which can reduce the resistance exerting on the inner cylinder 600 when the inner cylinder 600 rotates relative to the housing H. Accordingly, the smoothness of winding and unwinding the wire 900 can be enhanced. The statement of "the projection M2 is a regular triangle" refers a shape of the projection M2 is a regular triangle or substantially a regular triangle. In the embodiment, since the projection D of the non-contact portion 614 is an arc rather than a straight line, the shape of the projection M2 is approximate to a regular triangle, i.e., the projection M2 is substantially a regular triangle. In other embodiment, when the projection D of the non-contact portion 614 is a straight line, the shape of the projection M2 can be a regular triangle.

In the embodiment, each of the thread 611 of the external thread structure 610 includes three contact portions 613 and three non-contact portions 614, and the projection M2 of the external thread structure 610 on the plane perpendicular to the central axis A is a regular triangle, which is exemplarily and the present disclosure is not limited thereto. In other embodiment, the number of the contact portions 613 and the non-contact portions 614 of the external thread structure 610 can be adjusted. As long as the external thread structure 610 includes at least two contact portions 613 and at least two non-contact portions 614, the effects of reducing friction between the inner cylinder 600 and the housing H and improving the smoothness of winding and unwinding the wire 900 can be achieved. According to the number and arrangement of the contact portions 613 and the non-contact portions 614 of the external thread structure 610, the projection M2 of the external thread structure 610 on the plane perpendicular to the central axis A can be a non-circular shape, such as an ellipse, a polygon or a regular polygon. In the embodiment, the at least two contact portions 613 and the at least two non-contact portions 614 are located at the same thread 611. However, the present disclosure is not limited thereto. In other embodiment, at least one contact portion 613 and at least one non-contact portion 614 can be formed at one of the threads 611, and the at least two contact portions 613 are located at two of the threads 611, respectively. For details, reference can be made to the relevant description in FIG. 8.

As shown in FIG. 4 and FIG. 5, a first end 910 of the wire 900 is connected to the inner cylinder 600 and is wound along the external thread structure 610 of the inner cylinder 600. As the inner cylinder 600 is displaced along the central axis A by rotating relative to the housing H, a portion of the wire 900 is capable of being wound around or separated from the external thread structure 610 of the inner cylinder 600. Specifically, as the inner cylinder 600 displaces along the central axis A from the bottom end B of the housing H to a top end T of the housing H, i.e., the state of the winding mechanism 10 changes from FIG. 4 to FIG. 5, a portion of the wire 900 is capable of being wound around the external thread structure 610 of the inner cylinder 600, such that a length of the wire 900 exposed from the housing H is shortened. As the inner cylinder 600 displaces along the central axis A from the top end T of the housing H to the bottom end B of the housing H, i.e., the state of the winding mechanism 10 changes from FIG. 5 to FIG. 4, a portion of the wire 900 is capable of being separated from the external thread structure 610 of the inner cylinder 600, such that the length of the wire 900 exposed from the housing H is lengthened. Thereby, the wire 900 is wound along a fixed track, which is beneficial to reduce the space for receiving the wire 900 and reduce the volume of the winding mechanism 10.

As shown in FIGS. 2, 4 and 5, the winding mechanism 10 can further include a dynamic elastic member 700 (e.g. power spring). The dynamic elastic member 700 is configured to provide kinetic energy for the inner cylinder 600 to rotate relative to the housing H. The dynamic elastic member 700 is disposed in the accommodating space S. A central pole 820 is formed at the bottom end B of the housing H. Herein, the central pole 820 is exemplarily formed on the second body 800. A first end 710 (see FIG. 2) of the dynamic elastic member 700 is connected to the central pole 820 of the housing H, and a second end 720 (see FIG. 4) of the dynamic elastic member 700 is connected to the inner cylinder 600. As shown in FIG. 3, the central pole 820 is formed with at least one groove 821, the inner surface of the inner cylinder 600 is formed with a groove 620, and the first end 710 and the second end 720 of the dynamic elastic member 700 are fixed to the grooves 821, 620, respectively. Thereby, when the inner cylinder 600 is displaced along the central axis A relative to the central pole 820, the dynamic elastic member 700 can be deformed to accumulate an elastic restoring force, and the elastic restoring force can provide the kinetic energy for the inner cylinder 600 to rotate relative to the housing H.

The dynamic elastic member 700 can be a planar spiral spring. The planar spiral spring has a degree of freedom of two directional stretching. For example, the dynamic elastic member 700 in FIG. 4 is in a state of stretching downward slightly, and the dynamic elastic member 700 in FIG. 5 is in the state of stretching upward. In the embodiment, the dynamic elastic member 700 is exemplarily a scroll spring. However, the present disclosure is not limited thereto. The planar spiral spring can also be a constant force spring, a power spring, a preloaded spring or a constant torque spring.

In FIG. 4, a free length of the dynamic elastic member 700 parallel to the central axis A is L0, a length of the inner cylinder 600 parallel to the central axis A is L1, and the following condition can be satisfied: $L0<L1$. Therefore, when the dynamic elastic member 700 is not stretched by the inner cylinder 600, the dynamic elastic member 700 can be completely accommodated in the inner space of the inner cylinder 600. Therefore, an extra space to accommodate the dynamic elastic member 700 is not required, which is favorable for reducing the volume of the winding mechanism 10.

Please refer to FIGS. 1, 2 and 4, the winding mechanism 10 can optionally include a frame 200. The first body 300 of the housing H can be fixed to an external support through the frame 200. When the winding mechanism 10 is applied to a device requiring power, such as a lamp, the winding mechanism 10 can optionally include a power distributing box 100, a driving member 400 and a retractable conductive assembly 500. The wire 900 can be a conductive wire. The power distributing box 100 can be used to accommodate a power cord and relevant electronic components. The driving member 400 can be configured to convert an alternating current of a utility power into a direct current and then supply the direction current to the winding mechanism 10 through the conductive wire. The retractable conductive assembly 500 is electrically connected to the wire 900 to form an internal conductive wire of the winding mechanism 10. One end of the internal wire can be connected to a power supply, and the other end of the internal wire can be connected to a power consumption unit. Take the lamp as an example, one end of the internal wire can be connected to the utility power, and the other end of the internal wire can be connected to the lamp body.

The retractable conductive assembly 500 is disposed in the accommodating space S. An end of the retractable conductive assembly 500 abuts against the top end T of the housing H, and another end of the retractable conductive assembly 500 abuts against the inner cylinder 600. As shown in FIG. 4 and FIG. 5, when the inner cylinder 600 is displaced along the central axis A, the retractable conductive assembly 500 parallel to the central axis A is capable of being uncompressed or compressed. As shown in FIGS. 2, 4, and 5, the retractable conductive assembly 500 can include an outer conductive elastic member 510, an inner conductive elastic member 520, a first conductive part 530, a second conductive part 540, a third conductive part 550 and a fourth conductive part 560. The first conductive part 530 and the second conductive part 540 are disposed in the first body 300, and are disposed at an inner side and an outer side of a partition wall 320 (see FIG. 4), respectively. The third conductive part 550 and the fourth conductive part 560 are disposed in the inner cylinder 600, and are disposed at an inner side and an outer side of a partition wall 630 (see FIG. 4), respectively. The inner conductive elastic member 520 is disposed at the inner sides of the partition walls 320 and 630, and two ends of the inner conductive elastic member 520 are rotatably abut against the first conductive part 530 and the third conductive part 550, respectively. The outer conductive elastic member 510 is disposed at the outer sides the partition walls 320 and 630, and two ends of the outer conductive elastic member 510 rotatably abut against the second conductive part 540 and the fourth conductive part 560, respectively. Thereby, when the inner cylinder 600 is displaced along the central axis A, for example, when the state of the winding mechanism 10 changes from FIG. 4 to FIG. 5, the retractable conductive assembly 500 parallel to the central axis A is compressed while the retractable conductive assembly 500 in not twisted and entangled. For another example, when the state of the winding mechanism 10 changes from FIG. 5 to FIG. 4, the retractable conductive assembly 500 parallel to the central axis A is uncompressed while the retractable conductive assembly 500 in not twisted and entangled. Since the retractable conductive assembly 500 is not twisted and entangled when the retractable conductive assembly 500 is compressed or uncompressed, there is no need to reserve a space for the retractable conductive assembly 500 to twist and entangle, which is beneficial to reduce the volume of the winding mechanism 10. In addition, the dynamic elastic member 700 and the retractable conductive assembly 500 share the accommodating space S as the space for deformation, the winding mechanism 10 does not need to dispose independent spaces for the dynamic elastic member 700 and the retractable conductive assembly 500, which is beneficial to further reduce the volume of the winding mechanism 10.

Figure 8:
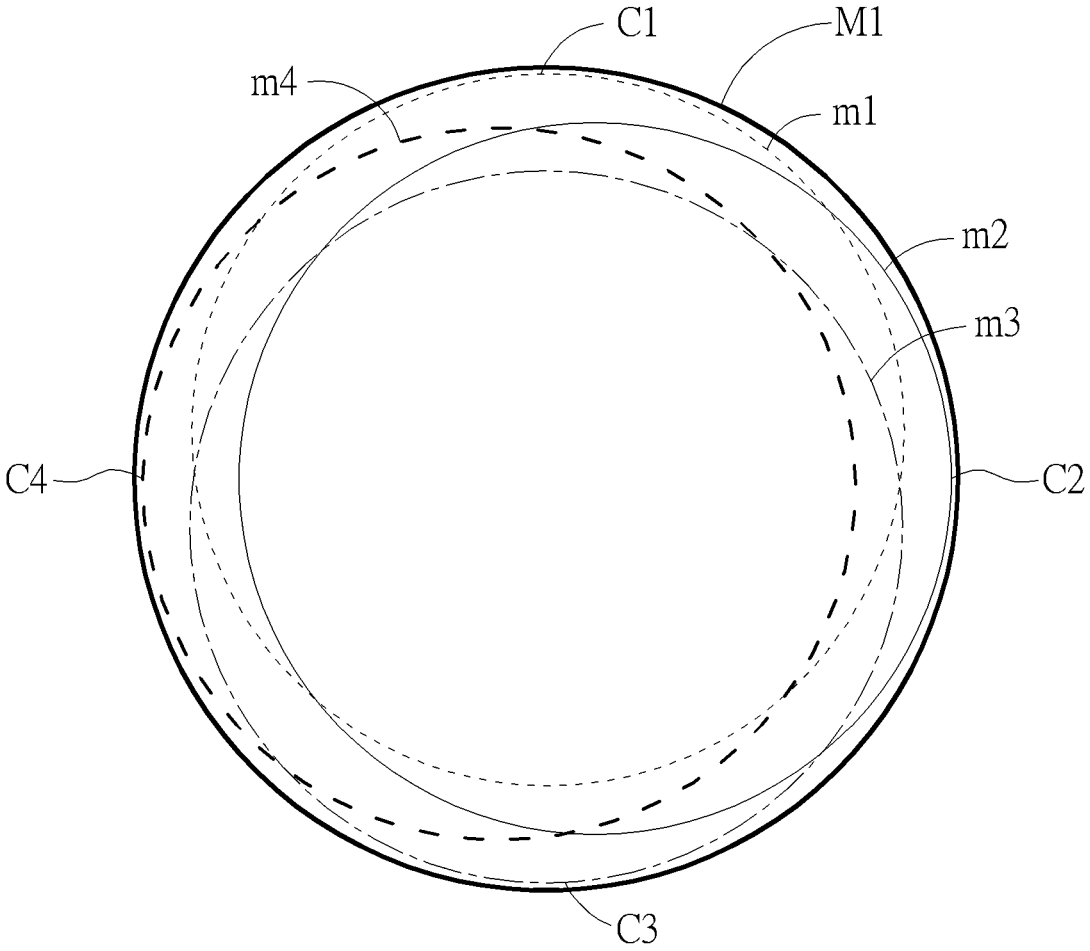
FIG. 8 is a schematic view showing projections of an external thread structure of an inner cylinder and an internal thread structure of a housing on a plane perpendicular to a central axis according to another embodiment of the present disclosure.

Please refer to FIG. 8, which is a schematic view showing projections of an external thread structure of an inner cylinder and the internal thread structure 810 of the housing H on the plane perpendicular to a central axis A according to another embodiment of the present disclosure. In the embodiment, the housing H is the same as the housing H in the aforementioned embodiment. The difference between the inner cylinder and the inner cylinder 600 in the aforementioned embodiment mainly is the external thread structure of the inner cylinder including at least four threads. When a number of the threads of the external thread structure is greater than four, the configuration of the fifth thread is the same as that of the first thread, the configuration of the sixth thread is the same as that of the second thread, and so on. Therefore, projections of the fifth thread and the first thread on the plane perpendicular to the central axis A overlap, and projections of the sixth thread and the second thread on the plane perpendicular to the central axis A overlap. That is, the projection of the external thread structure on the plane perpendicular to the central axis A is formed by projections of four threads on the plane perpendicular to the central axis A. In addition, one thread has a contact portion and a non-contact portion, and the plurality of contact portions of the external thread structure are located at different threads. In FIG. 8, the projection of the internal thread structure 810 on the plane perpendicular to the central axis A is M1 (hereinafter, projection M1). The projection M1 is a circle. The projections of the four threads on the plane perpendicular to the central axis A are m1, m2, m3 and m4 (hereinafter, projections m1, m2, m3 and m4). In order to improve the recognition, the projections m1, m2, m3 and m4 are shown in different line styles in FIG. 8. The projections m1, m2, m3, and m4 are not circles. Projections of the contact portions of the four threads on the plane perpendicular to the central axis A are C1, C2, C3, and C4 (hereinafter, projections C1, C2, C3, and C4). Thereby, the projection of the external thread structure on the plane perpendicular to the central axis A is a regular quadrilateral. More specifically, the projection is substantially a regular quadrilateral, and the projections C1, C2, C3, and C4 are located at vertices of the regular quadrilateral.

Figure 9:
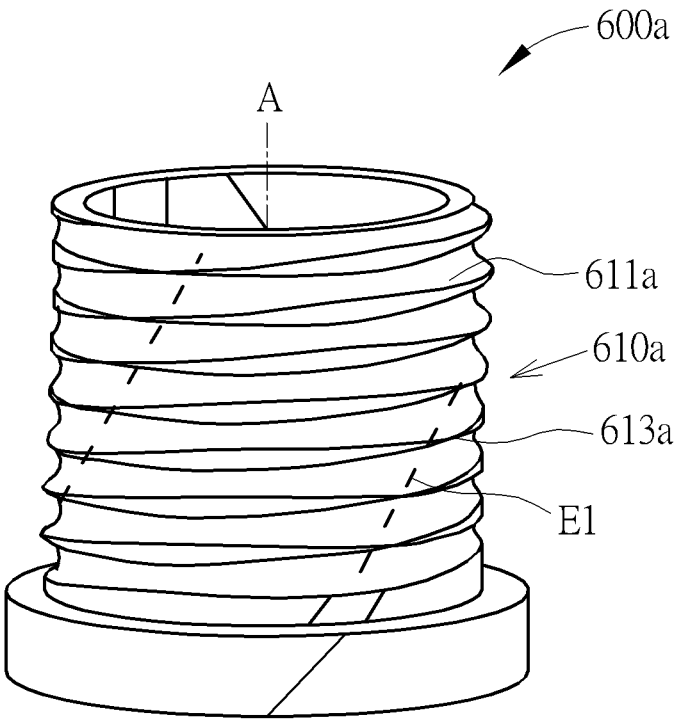
FIG. 9 is a three-dimensional diagram showing an inner cylinder according to yet another embodiment of the present disclosure.

Please refer to FIG. 9, which is a three-dimensional diagram showing an inner cylinder 600*a* according to yet another embodiment of the present disclosure. An outer surface of the inner cylinder 600*a* is formed with an external thread structure 610*a*, and the external thread structure 610*a* includes a plurality of threads 611*a*. The difference between the inner cylinder 600*a* and the inner cylinder 600 mainly is the configuration of the plurality of threads 611*a*. In FIG. 9, different threads 611*a* are misaligned with each other along the central axis A, so that projections of the plurality of threads 611*a* on the plane perpendicular to the central axis A vary in angle. More specifically, a contact portion 613*a* of a thread 611*a* deviates from a contact portion 613*a* of an adjacent thread 611*a* by a predetermined angle relative to the central axis A, so that a connecting line E1 of the contact portions 613*a* of the plurality of threads 611*a* is not parallel to the central axis A. Thereby, a balanced contact via multiple points between the inner cylinder 600*a* and the housing H can be achieved, and problems, such as increased friction and difficulty in rotation, due to eccentricity resulted in manufacturing tolerances can be avoided. Preferably, the angles of the contact portions 613*a* of the plurality of threads 611*a* relative to the central axis A can be arranged to change gradually, so that the projection of the external thread structure 610*a* on the plane perpendicular to the central axis A can be a circle. Thereby, when the inner cylinder 600*a* rotates relative to the housing H, the contact between the external thread structure 610*a* and the internal thread structure 810 is more continuous, which can further improve the smoothness of winding and unwinding the wire 900.

Figure 10:
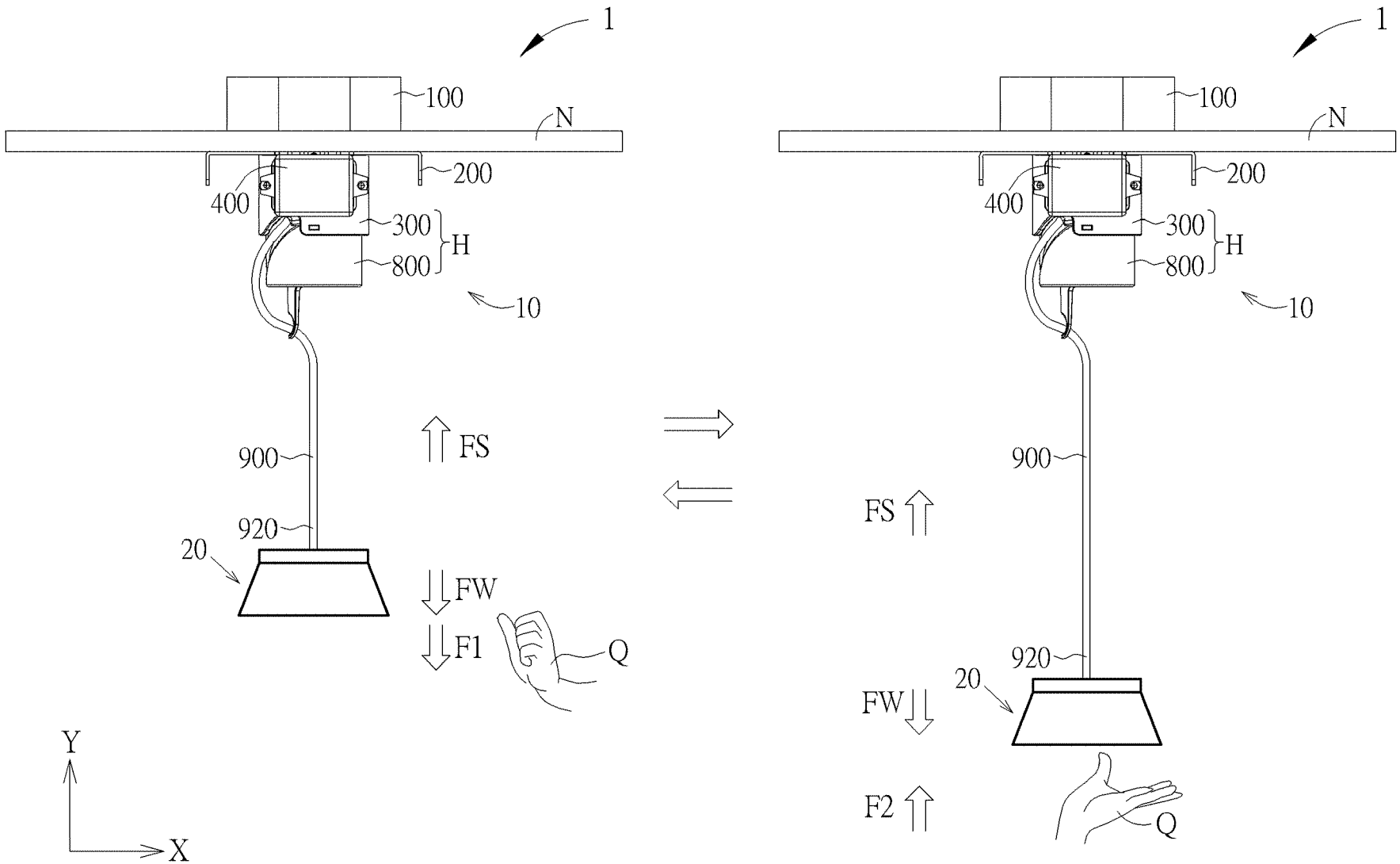
FIG. 10 is a schematic view showing the winding mechanism of FIG. 1 applied to a lamp.

Please refer to FIG. 10, which is a schematic view showing the winding mechanism 10 of FIG. 1 applied to a lamp 1. The lamp body 20 in the left side is in a relatively high position, i.e., a user can increase an exposed length of the wire 900, and the lamp body 20 in the right side is in a relatively low position, i.e., the user can reduce the exposed length of the wire 900. The lamp 1 includes the winding mechanism 10 and the lamp body 20. The winding mechanism 10 is suspended on an external support N, and the lamp body 20 is connected to a second end 920 of the wire 900. Herein, the external support N is exemplarily a ceiling. The power distributing box 100 is disposed above the external support N. The first body 300 of the winding mechanism 10 is fixed below the external support N through the frame 200, the wire 900 is a conductive wire, and the wire 900 is electrically connected to the retractable conductive assembly 500. For details of the winding mechanism 10, reference can be made to the above description and are not repeated herein.

Figure 11:
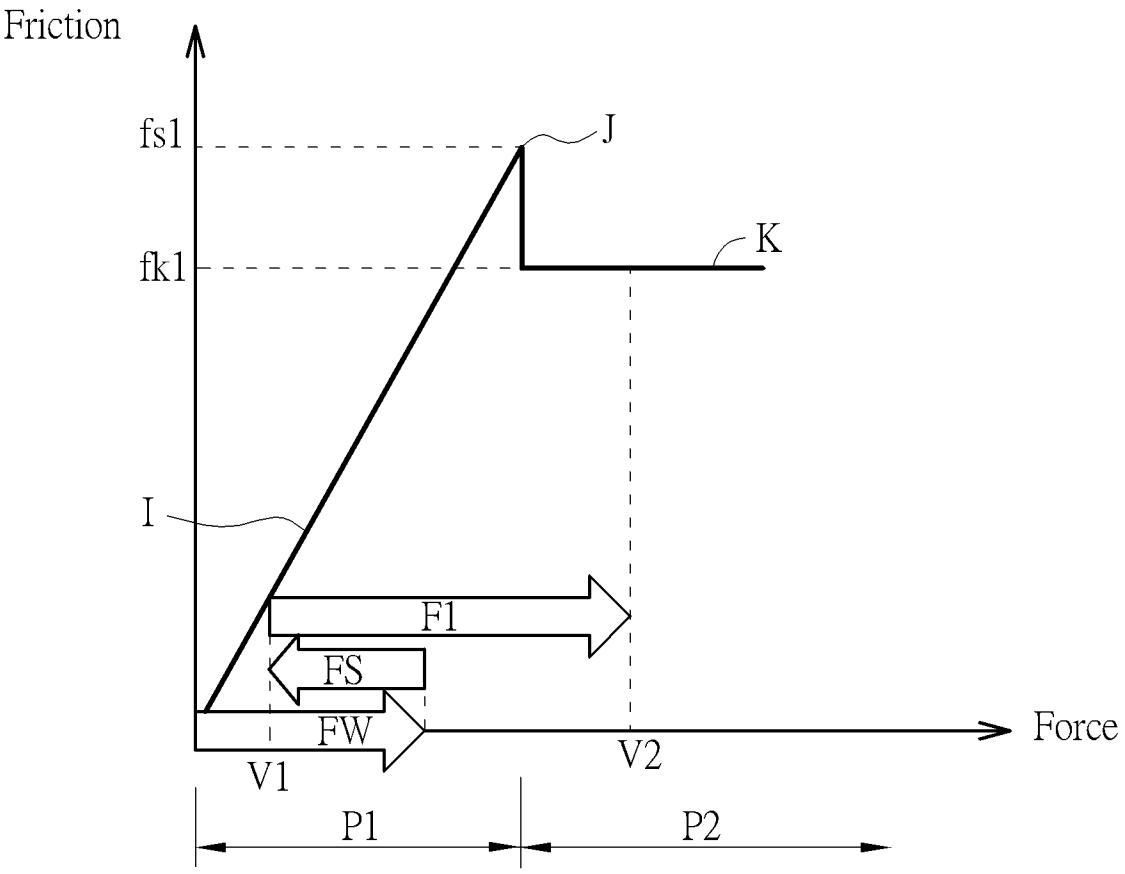
FIG. 11 shows a relationship between a friction and a force of the lamp of FIG. 10 in a relatively high position.
Figure 12:
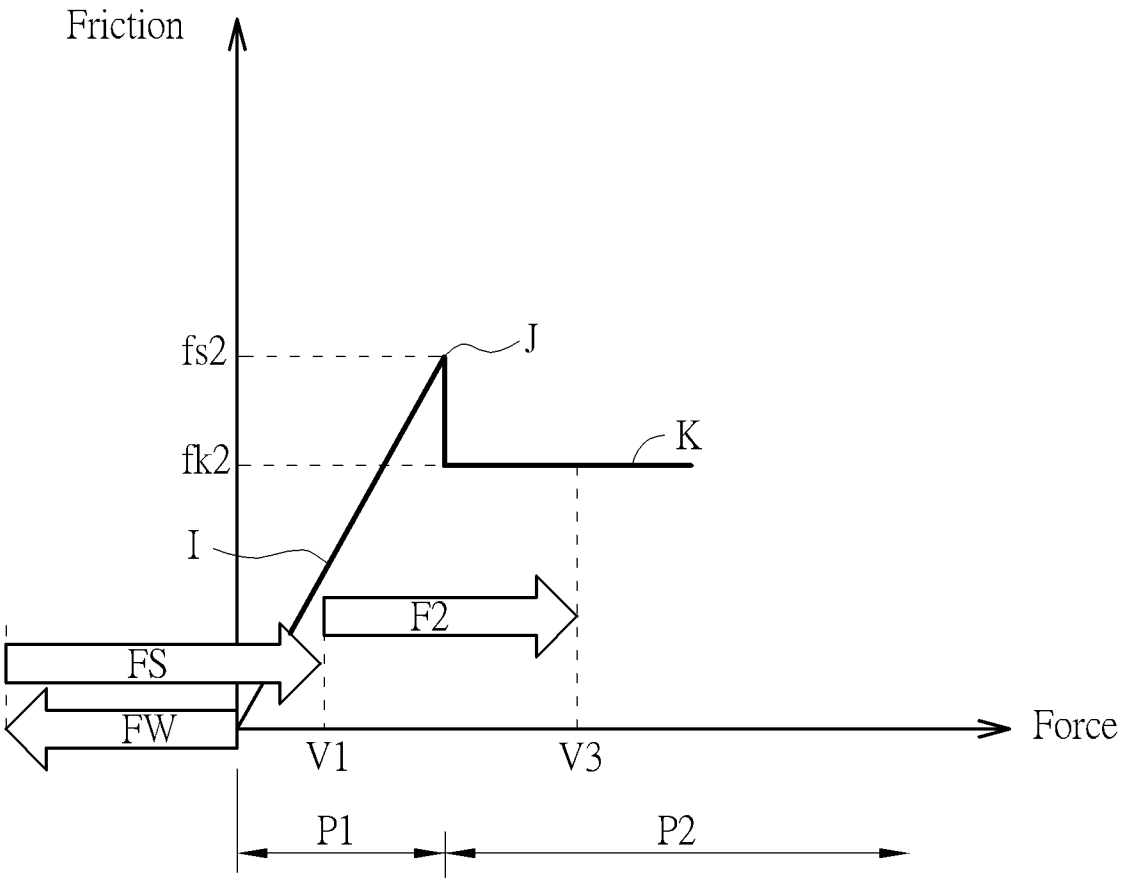
FIG. 12 shows a relationship between a friction and a force of the lamp of FIG. 10 in a relatively low position.

How the dynamic elastic member 700 providing kinetic energy for the inner cylinder 600 to rotate relative to the housing H is explained with the example shown in FIG. 10 to FIG. 12, in which the winding mechanism 10 is applied to the lamp 1. For the sake of convenience, the following description is made with the XY coordinate system. In addition, when a phrase of "downward" or "face downward" is use to describe a direction, it refers that the direction is parallel to Y axis and faces downward. Similarly, when a phrase of "upward" or "face upward" is use to describe a direction, it refers that the direction is parallel to Y axis and faces upward. Specifically, no matter the lamp body 20 is in the relatively high position in the left side of FIG. 10 (corresponding to FIG. 5) or in the relatively low position in the right side of FIG. 10 (corresponding to FIG. 4), a sum of a gravity force FW exerted on the lamp body 20 and the elastic restoring force FS generated by the dynamic elastic member 700 due to a compression deformation or an extension deformation is not greater than a maximum static friction fs1 and fs2 (see FIGS. 11 and 12) of the winding mechanism 10. In the embodiment, the dynamic elastic member 700 is exemplarily a scroll spring. When the lamp body 20 is in the relatively high position shown in FIG. 5, the deformation amount of the scroll spring is relatively small. The force that the scroll spring exerts on the inner cylinder 600 and the second body 800 is relatively small. During the process that the user pulls the lamp body 20 from the relatively high position shown in FIG. 5 to the relatively low position shown in FIG. 4, the deformation amount of the scroll spring is increased gradually. When the wire 900 is pulled to a longest exposing length, i.e., the deformation amount of the scroll spring is relatively large, the force that the scroll spring exerts on the inner cylinder 600 and the second body 800 is relatively large. Therefore, based on the different deformation amounts of the scroll spring, the line graphs representing the relationships of the friction and the force in FIG. 11 and FIG. 12 are different.

Please refer to FIG. 11 and FIG. 12, which show the line graphs representing the relationships of the friction and the force. Specifically, the aforementioned force can be the resultant force of the gravity force FW, the elastic restoring force FS and a first external force F1 that faces downward or a second external force F2 that faces upward. When the user does not exert a force, the first external force F1 and the second external force F2 are 0. The aforementioned friction can include a friction between the inner cylinder 600 and the housing H and a friction between the housing H (such as the guiding structure 830) and the wire 900. That is, the aforementioned friction can be a resultant force of the friction between the inner cylinder 600 and the housing H and the friction between the housing H and the wire 900. The lamp 1 has a static friction, a maximum static friction fs1/fs2 and a kinetic friction fk1/fk2. The region P1 represents that the inner cylinder 600 is in a static state. The region P2 represents that the inner cylinder 600 is in a rotating state. The value of the friction corresponding to the oblique line I is the static friction. The value of the friction corresponding to the point J is the maximum static friction fs1/fs2. The value of the friction corresponding to the horizontal line K is the kinetic friction fk1/fk2. The kinetic friction fk1/fk2 is less than the maximum static friction fs1/fs2 and is a constant value. As mentioned in the previous paragraph, when the deformation amount of the scroll spring is maximal, even the scroll spring has a tendency to return to the free state, the force exerted by the scroll spring on the inner cylinder 600 and the second body 800 cannot overcome the maximum static friction fs1/fs2 of the lamp 1 corresponding to the point J.

Please refer to FIG. 10 and FIG. 11, the dynamic elastic member 700 is preset to have an elastic restoring force at the beginning that the dynamic elastic member 700 is installed in the inner cylinder 600 and the second body 800. As shown in the left side of FIG. 10, when the user does not exert an external force on the lamp 1, the inner cylinder 600 is in the static state relative to the housing H, corresponding to FIG. 11, a magnitude of a resultant force of the gravity force FW exerted on the lamp body 20 and an elastic restoring force FS of the dynamic elastic member 700 is a first value V1, and a friction corresponding to the first value V1 is smaller than the maximum static friction fs1 of the lamp 1. According the directionality of the force (herein, the downward direction is positive and the upward direction is negative), the first value V1 is an absolute value of the gravity force FW minus the elastic restoring force FS, and the lamp body 20 is capable of staying at any height and is in the static state.

When the user wants to adjust the hanging length of the lamp 1, for example, to change the lamp 1 from the relatively high position in the left side to the relatively low position in the right side shown in FIG. 10, the user can pull the lamp body 20 downward by hand Q. Thereby, an external force is exerted on the winding mechanism 10 through the lamp body 20, which can correspond to the state of the winding mechanism 10 changing from FIG. 5 to FIG. 4. As shown in the left side in FIG. 10, when the first external force F1 is exerted downward on the winding mechanism 10, corresponding to FIG. 11, a magnitude of a resultant force of the first external force F1, the gravity force FW exerted on the lamp body 20 and the elastic restoring force FS of the dynamic elastic member 700 is a second value V2, and a friction corresponding to the second value V2 is greater than the maximum static friction fs1 of the lamp 1, such that the inner cylinder is capable of rotating relative to the housing H and entering to the rotating state from the static state. Till the first external force F1 is removed, the inner cylinder 600 stops rotating relative to the housing H (i.e., the second value V2 is reduced to the first value V1). In the rotating state, according to the directionality of the force (the downward direction is positive and the upward direction is negative), the second value V2 is an absolute value of a sum of the first external force F1 and the gravity force FW exerted on the lamp body 20 minus the elastic restoring force FS of the dynamic elastic member 700. During the process of exerting the first external force F1, the inner cylinder 600 is displaced along the central axis A from the top end T of the housing H to the bottom end B of the housing H, and a portion of the wire 900 is capable of being separated from the external thread structure 610 of the inner cylinder 600, so that the length of the wire 900 exposed from the housing H is lengthened, and the lamp 1 is changed from the relative high position in the left side to the relative low position in the right side shown in FIG. 10, which can correspond to the state of the winding mechanism 10 changing from FIG. 5 to FIG. 4.

Please refer to FIG. 10 and FIG. 12, when the user wants to adjust the hanging length of the lamp 1, for example, to change the lamp 1 from the relatively low position in the right side to the relatively high position in the left side shown in FIG. 10, the user can push the lamp body 20 upward by hand Q. Thereby, an external force is exerted on the winding mechanism 10 through the lamp body 20, which can correspond to the state of the winding mechanism 10 changing from FIG. 4 to FIG. 5. As shown in the right side of FIG. 10, when the second external force F2 is exerted upward on the winding mechanism 10, corresponding to FIG. 12, a magnitude of a resultant force of the second external force F2, the gravity force FW exerted on the lamp body 20 and the elastic restoring force FS of the dynamic elastic member 700 is a third value V3, and a friction corresponding to the third value V3 is greater than the maximum static friction fs2 of the lamp 1, such that the inner cylinder 600 is capable of rotating relative to the housing H and entering to the rotating state from the static state. Till the second external force F2 is removed, the inner cylinder 600 stops rotating relative to the housing H (i.e., the third value V3 is reduced to the first value V1). In the rotating state, according to the directionality of force (upward direction is positive and downward is negative), the third value V3 is an absolute value of a sum of the second external force F2 and the elastic restoring force FS of the dynamic elastic member 700 minus the gravity force FW exerted on the lamp body 20. During the process of exerting the second external force F2, the inner cylinder 600 is displaced along the central axis A from the bottom end B of the housing H to the top end T of the housing H, so that a portion of the wire 900 is capable of being wound around the external thread structure 610 of the inner cylinder 600, so that the length of the wire 900 exposed from the housing H is shortened, and the state of the lamp 1 is changed from the right side to the left side shown in FIG. 10, which can correspond to the state of the winding mechanism 10 changing from FIG. 4 to FIG. 5.

In FIG. 11 and FIG. 12, when the external force is exerted on the winding mechanism 10, the external force exerted on the winding mechanism 10 does not need to maintain a constant value. The external force only requires to overcome the maximum static friction fs1/fs2 at the beginning, such as the first external force F1 and the second external force F2. Once the inner cylinder 600 starts to rotate, the external force can be changed to have a magnitude capable of overcoming the kinetic friction fk1/fk2, so that the inner cylinder 600 can remain in the rotating state.

In addition, the coefficient of friction between of the inner cylinder 600 and the housing H can be determined by selecting the materials of the inner cylinder 600 and the housing H. The coefficient of elasticity of the dynamic elastic member 700 can be determined by selecting the specification of the dynamic elastic member 700. The weight of the lamp body 20 can be determined by selecting the specification of the lamp body 20. Thereby, the elastic restoring force FS provided by the dynamic elastic member 700, the maximum static friction fs1/fs2 and the kinetic friction fk1/fk2 of the lamp 1, and the gravity force FW exerted on the lamp body 20 are proper, which is beneficial for the user to exert a force slightly on the lamp body 20, and the force, the elastic restoring force FS provided by the dynamic elastic member 700 and the gravity force FW exerted on the lamp body 20 can cooperate with each other to overcome the maximum static friction fs1/fs2 of the lamp 1, so that the inner cylinder 600 is capable of displacing along the central axis A to wind or unwind the wire 900. Accordingly, the lamp body 20 is capable of displacing with the user's hand Q. When the user's hand Q moves away from the lamp body 20, the lamp body 20 stops displacing immediately. That is, it can provide the operation experience that the lamp body 20 stays at the position where the user's hand Q stops to move. The user does not need to perform additional operations to fix the position of the lamp body 20. Thereby, an excellent hand feeling of the user to operate the winding mechanism 10 to wind and unwind the wire 900 can be improved.

Compared with the prior art, in the winding mechanism according to the present disclosure, via the inner cylinder displacing along the central axis by rotating relative to the housing, a portion of the wire is capable of being wound around or separated from the external thread structure of the inner cylinder, which allows the wire to be wound along the fixed track. It is beneficial to reduce the space for receiving the wire and can reduce the volume of the winding mechanism. In the winding mechanism according to the present disclosure, via gaps formed between the non-contact portions of the external thread structure and the internal thread structure, the friction between the internal thread structure and the external thread structure can be reduced, and the smoothness of winding and unwinding the wire can be improved. The winding mechanism of the present disclosure can be applied to the lamp, which is beneficial for users to adjust the hanging length of the lamp according to practical needs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A winding mechanism, comprising:

a housing formed with an accommodating space therein, wherein an inner surface of the housing is formed with an internal thread structure;

an inner cylinder disposed in the accommodating space, wherein the inner cylinder defines a central axis, an outer surface of the inner cylinder is formed with an external thread structure, the external thread structure is cooperated with the internal thread structure, the inner cylinder is capable of displacing along the central axis by rotating relative to the housing, the external thread structure comprises at least two contact portions and at least two non-contact portions, and gaps are formed between the non-contact portions of the external thread structure and the internal thread structure; and a wire, wherein an end of the wire is connected to the inner cylinder and is wound along the external thread structure of the inner cylinder, and as the inner cylinder is displaced along the central axis by rotating relative to the housing, a portion of the wire is capable of being wound around or separated from the external thread structure of the inner cylinder.

2. The winding mechanism of claim 1, wherein the external thread structure comprises a plurality of threads, at least one of the contact portions and at least one of the non-contact portions are formed at one of the plurality of threads, and the at least two contact portions are respectively located at two of the plurality of threads.

3. The winding mechanism of claim 1, wherein the external thread structure comprises a plurality of threads, and the at least two contact portions and the at least two non-contact portions are formed at one of the plurality of threads.

4. The winding mechanism of claim 1, wherein a projection of the external thread structure on a plane perpendicular to the central axis is an ellipse or a regular polygon, and a projection of the internal thread structure on the plane perpendicular to the central axis is a circle.

5. The winding mechanism of claim 1, wherein the external thread structure comprises a plurality of threads, and projections of the plurality of threads on a plane perpendicular to the central axis vary in angle.

6. The winding mechanism of claim 1, wherein the external thread structure comprises a plurality of threads, a thread groove is disposed between two of the plurality of threads adjacent to each other, and the thread groove has an arc-shaped bottom surface.

7. The winding mechanism of claim 1, wherein:

as the inner cylinder displaces along the central axis from a bottom end of the housing to a top end of the housing, a portion of the wire is capable of being wound around the external thread structure of the inner cylinder, such that a length of the wire exposed from the housing is shortened; and as the inner cylinder displaces along the central axis from the top end of the housing to the bottom end of the housing, a portion of the wire is capable of being separated from the external thread structure of the inner cylinder, such that a length of the wire exposed from the housing is lengthened.

8. The winding mechanism of claim 1, wherein the housing comprises a first body and a second body, the first body is configured to be fixed on an external support, a relative position between the first body and the external support is fixed, and the internal thread structure is formed on the second body.

9. The winding mechanism of claim 1, wherein the housing further comprises a guiding structure, and the wire enters the accommodating space or leaves the accommodating space through the guiding structure.

10. The winding mechanism of claim 9, wherein the guiding structure comprises:

a concave groove formed on an outer surface of the housing.

11. The winding mechanism of claim 9, wherein the guiding structure comprises:

a lug extending from a bottom end of the housing, wherein the lug is formed with a through hole, and the wire passes through the through hole.

12. The winding mechanism of claim 1, further comprising:

a dynamic elastic member disposed in the accommodating space, wherein a central pole is formed at a bottom end of the housing, an end of the dynamic elastic member is connected to the central pole of the housing, another end of the dynamic elastic member is connected to the inner cylinder, and the dynamic elastic member is configured to provide kinetic energy for the inner cylinder to rotate relative to the housing.

13. The winding mechanism of claim 12, wherein the dynamic elastic member is a planar spiral spring.

14. The winding mechanism of claim 12, wherein a free length of the dynamic elastic member parallel to the central axis is L0, a length of the inner cylinder parallel to the central axis is L1, and the following condition is satisfied:

$$L0<L1.$$

15. A lamp, comprising:

the winding mechanism of claim 1, wherein the winding mechanism is suspended on an external support; and a lamp body connected to another end of the wire.

16. A lamp, comprising:

the winding mechanism of claim 12, wherein the winding mechanism is suspended on an external support; and a lamp body connected to another end of the wire.

17. The lamp of claim 16, wherein the lamp has a kinetic friction and a maximum static friction, and a gravity force is exerted on the lamp body;

when the inner cylinder is in a static state relative to the housing, a magnitude of a resultant force of the gravity force exerted on the lamp body and an elastic restoring force of the dynamic elastic member is a first value, and a friction corresponding to the first value is smaller than the maximum static friction of the lamp;

when a first external force is exerted downward on the winding mechanism, a magnitude of a resultant force of the first external force, the gravity force exerted on the lamp body and the elastic restoring force of the dynamic elastic member is a second value, and a friction corresponding to the second value is greater than the maximum static friction of the lamp, such that the inner cylinder is capable of rotating relative to the housing and entering to a rotating state from the static state, and till the first external force is removed to reduce the second value to the first value, the inner cylinder stops rotating relative to the housing.

18. The lamp of claim 16, wherein the lamp has a kinetic friction and a maximum static friction, and a gravity force is exerted on the lamp body;

when the inner cylinder is in a static state relative to the housing, a magnitude of a resultant force of the gravity force exerted on the lamp body and an elastic restoring force of the dynamic elastic member is a first value, and a friction corresponding to the first value is smaller than the maximum static friction of the lamp;

when a second external force is exerted upward on the winding mechanism, a magnitude of a resultant force of the second external force, the gravity force exerted on the lamp body and the elastic restoring force of the dynamic elastic member is a third value, and a friction corresponding to the third value is greater than the maximum static friction of the lamp, such that the inner cylinder is capable of rotating relative to the housing and entering to a rotating state from the static state, and till the second external force is removed to reduce the third value to the first value, the inner cylinder stops rotating relative to the housing.

19. The lamp of claim 17, wherein the kinetic friction or the maximum static friction comes from a friction between the inner cylinder and the housing and a friction between the housing and the wire.

20. The lamp of claim 16, further comprising:

a retractable conductive assembly disposed in the accommodating space, an end of the retractable conductive assembly abuts against a top end of the housing, and another end of the retractable conductive assembly abuts against the inner cylinder;

wherein the retractable conductive assembly parallel to the central axis is capable of being uncompressed or compressed as the inner cylinder displaces along the central axis.

* * * * *